US006828534B2

(12) United States Patent
Leutner et al.

(10) Patent No.: US 6,828,534 B2
(45) Date of Patent: Dec. 7, 2004

(54) MICROWAVE UNIT DOOR WITH VIEWING WINDOW

(75) Inventors: Kurt Leutner, Mainz (DE); Dietrich Busch, Kastellaun (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 10/696,185

(22) Filed: Oct. 29, 2003

(65) Prior Publication Data

US 2004/0149748 A1 Aug. 5, 2004

(30) Foreign Application Priority Data

Oct. 29, 2002 (DE) ..... 102 50 298

(51) Int. Cl.[7] ..... H05B 6/76

(52) U.S. Cl. ..... 219/740; 219/739; 174/35 MS

(58) Field of Search ..... 219/739, 740, 219/741, 742, 743, 744, 756; 174/35 MS, 35 GC, 35 R

(56) References Cited

U.S. PATENT DOCUMENTS 2,958,754 A * 11/1960 Hahn ..... 219/740
3,305,623 A * 2/1967 Bakker et al. ..... 174/35 MS
4,010,343 A * 3/1977 Tanaka et al. ..... 219/740
4,631,214 A * 12/1986 Hasegawa ..... 428/68
4,678,699 A * 7/1987 Kritchevsky et al. ..... 428/175
5,012,041 A * 4/1991 Sims et al. ..... 174/35 MS
6,717,047 B2 * 4/2004 Haselby et al. ..... 174/35 R

* cited by examiner

*Primary Examiner*—Philip H. Leung
(74) *Attorney, Agent, or Firm*—Michael J. Striker

(57) ABSTRACT

The door for a microwave unit with a viewing window has a metallic door frame, two glass panes held spaced apart from each other between the metallic door frame and a fine woven fabric for blocking microwaves arranged between the glass panes. The fine woven fabric consists of thin metal fibers woven together preferably in a linen or plain weave and is in electrically conductive contact with the door frame. In order to improve observation of the interior of the microwave unit the thin metal fibers have a thickness of from 0.02 to 0.06 mm and have a spacing of from 0.09 to 0.12 mm.

4 Claims, 1 Drawing Sheet

MICROWAVE UNIT DOOR WITH VIEWING WINDOW

BACKGROUND OF THE INVENTION

1. Field of the Invention

The present invention relates to a door with a viewing window for a microwave unit and, more particularly, to a door with a viewing window for a microwave unit, which comprises a metallic door frame, two glass panes held spaced from each other between the metallic door frame and a metallic screen for screening or blocking microwaves arranged between the glass panes, which is in conductive contact with the metallic door frame.

2. Description of the Related Art

Doors for microwave units typically have a viewing window, in order to be able to better observe the cooking process in the microwave unit. This viewing window comprises two glass panes arranged spaced apart from each other in a metallic frame. The glass panes are made from a high temperature-resistant glass. Since this glass is also transparent for microwaves to some extent, a screen is necessary in the metallic frame to block microwave radiation in the vicinity of the viewing window.

In the known microwave units this screen comprises a blackened perforated metallic plate, which is rigidly attached in the space between both glass panes and is in electrically conductive contact with the metallic frame. This comparatively heavy perforated metallic plate of course blocks the microwave radiation to the required extent, however it significantly impairs observation of the interior of the microwave unit.

SUMMARY OF THE INVENTION

It is an object of the present invention to construct the microwave unit door in regard to the metallic screen, based on the above-describe microwave unit door with viewing window of the above-described type, which comprises a metallic door frame, in which two glass panes are spaced from each other, and a metallic screen for blocking or attenuating microwaves between the two glass panes, which is in conductive contact with the metallic door frame, so that, on the one hand, the metallic screen provides the required blocking or attenuation of the microwave radiation, which means that the legally required limit for emission of microwaves from the microwave unit is not exceeded, and, on the other hand, the metallic screen does not impair observation of the interior of the microwave unit from a practical standpoint.

This object and others, which will be made more apparent hereinafter, are attained in a door with a viewing window for a microwave unit, which comprises a metallic door frame, two glass panes held spaced apart from each other between the metallic door frame and a metallic screen for blocking or attenuating microwaves arranged between the glass panes, which is in electrically conductive contact with the metallic door frame.

According to the invention the metallic screen comprises a woven fabric of thin metal fibers, which are woven together with a predetermined small spacing.

This fine woven fabric, as experimentation has shown, blocks or attenuates the microwave radiation to the required extent and surprisingly allows a practically completely unblocked or unveiled view of the interior to the microwave unit. There is practically speaking no noticeable blocking of the view.

The term "thin metal fibers" within the sense of the present invention means metal fibers each with a thickness in a range from 0.02 mm to 0.1 mm, preferably about 0.06 mm.

The predetermined small spacing between metal fibers, i.e. the distance between opposing sides of adjacent individual metal fibers, is preferably in a range of 0.09 mm to 0.5 mm and amounts to about 0.12 mm in a preferred embodiment.

In the simplest case the woven fabric has a so-called linen or plain weave, in which the warp fiber or thread alternatively passes over and under the weft fiber or thread. Also other weaves of the fibers, for example, a body weave, are of course conceivable.

So that the thin metal fibers have sufficient tear resistance, the metal fibers preferably comprise steel fiber.

In order to avoid light scattering effects, the woven fabric, as in the known case of the perforated plate, is blackened.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENT

Figure 1:
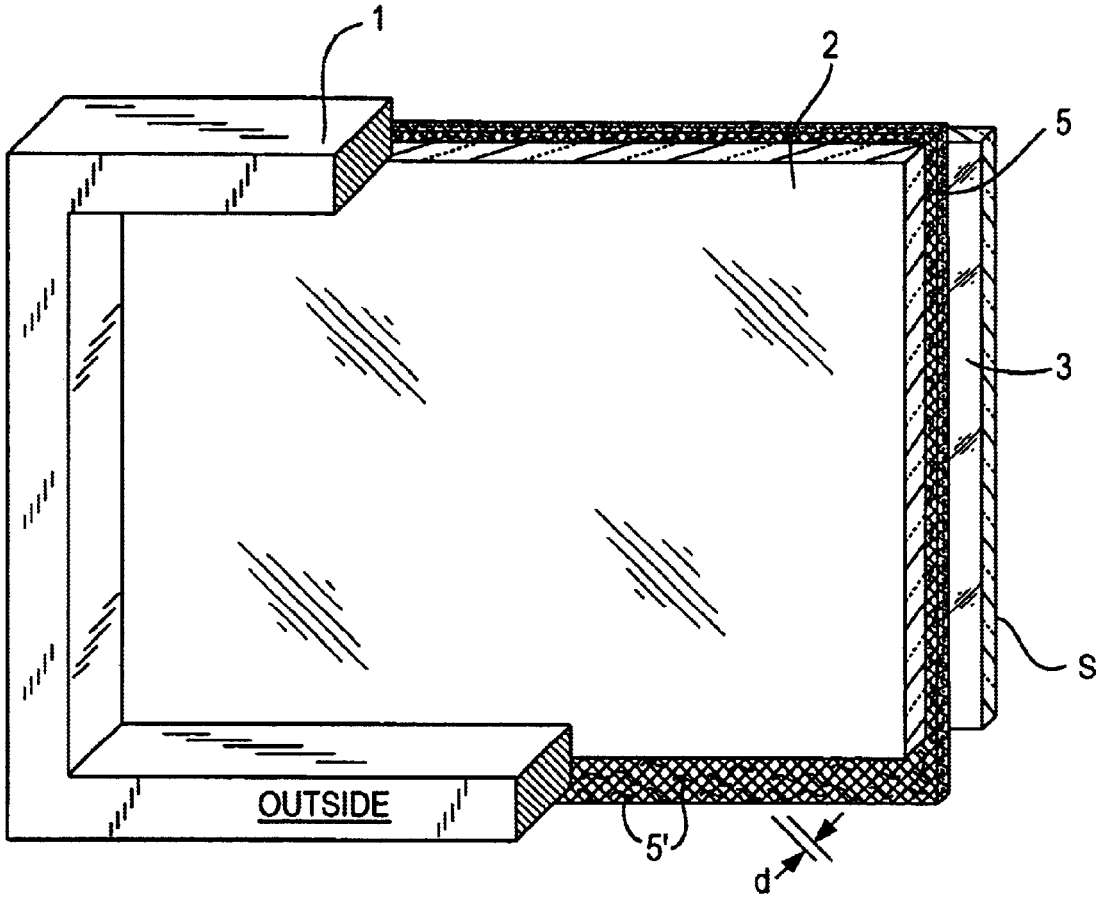
FIG. 1 is an exploded perspective view of a door with a viewing window for a microwave unit according to the invention, showing the structure of the door.
Figure 2:
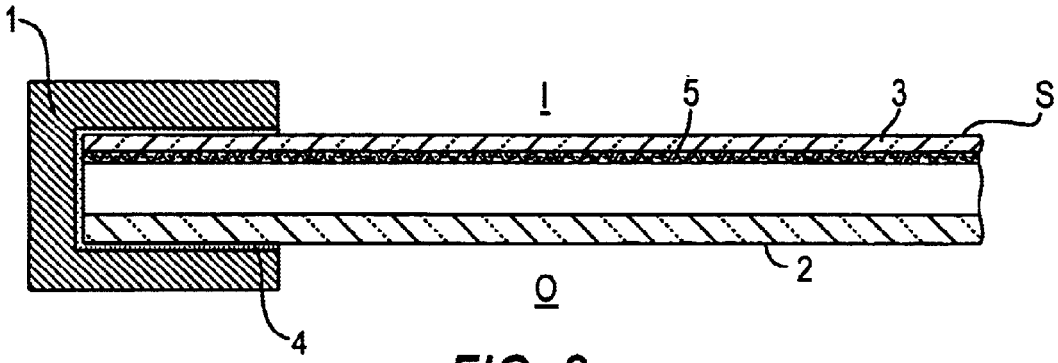
FIG. 2 is a horizontal cross-sectional view through the door shown in FIG. 1.

The door shown in the drawing with a viewing window for a microwave unit has a metallic frame 1, in which two glass panes 2,3 are held spaced from each other. The glass pane 3 closest to the unit interior I is preferably made of glass sold under the trademark DURAX®, while the glass pane 2 closest to the surroundings or outside O is preferably made of glass sold under the trademark BOROFLOAT® or DURAX®. The glass panes 2,3 are glued in the metallic frame 1, preferably by means of an adhesive 4.

To screen off or block microwave radiation in the vicinity of the viewing window a metallic screen 5, comprising a woven fabric of thin metal fibers 5', preferably steel fibers, is provided. The thin metal fibers 5' of the metallic screen are woven together with a predetermined small spacing. Preferably the metal fibers 5' are woven together in a so-called basket weave form, in which the warp fibers alternately pass over and under the weft fibers. This metallic screen 5 comprising the woven fabric is mounted on the inner side or inner surface S of the inner glass pane 3 facing the outer glass pane 2.

The metallic screen 5 comprising the woven metallic fabric used for screening has a very fine weave, which for example is also used in oil filters for motor vehicles. The thickness of each of the metal fibers 5' is in a range from 0.02 mm to 0.1 mm, preferably about 0.06 mm.

The spacing d of the opposing sides of adjacent metal fibers 5' from each other is in a range of 0.09 mm to 0.5 mm, preferably about 0.12 mm.

The woven metallic fabric used as the metallic screen 5 according to the invention is black because it is made from metal fibers 5' that are black or it is subsequently blackened.

The invention can basically be used in all units, in which a viewing window is provided and a screen for electromagnetic radiation is arranged in the viewing window.

The disclosure in German Patent Application 102 50 298.6-16 of Oct. 29, 2002 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a door with a viewing window for a microwave unit, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A door for a microwave unit with a viewing window, said door comprising a metallic door frame, two glass panes held spaced apart from each other in the metallic door frame and a fine woven fabric consisting of thin metal fibers, wherein said line woven fabric is arranged between said glass panes to block or attenuate microwave radiation and said thin metal fibers are in electrically conductive contact with the metallic door frame;

wherein said thin metal fibers of the fine woven fabric are woven together with a predetermined small spacing of from 0.09 to 0.12 mm and each of said thin metal fibers has a thickness of from 0.02 to 0.08 mm.

2. The door for the microwave unit as defined in claim 1, wherein said fine woven fabric has a linen or plain weave.

3. The door for the microwave unit as defined in claim 1, wherein said fine woven fabric is black in order to suppress light scattering effects.

4. The door as defined in claim 1, wherein the metal fibers consist of steel fibers.

* * * * *